US006598256B2

(12) United States Patent
Theriault

(10) Patent No.: US 6,598,256 B2
(45) Date of Patent: Jul. 29, 2003

(54) MULTI-USE CLEANING DEVICE

(76) Inventor: Patrick S. Theriault, 1545 Mansfield St., Santa Cruz, CA (US) 95062

( * ) Notice: Subject to any disclaimer, the term of this patent is extended or adjusted under 35 U.S.C. 154(b) by 143 days.

(21) Appl. No.: 09/843,385

(22) Filed: Apr. 25, 2001

(65) Prior Publication Data

US 2002/0157179 A1 Oct. 31, 2002

(51) Int. Cl.[7] ..... A46B 11/00; A46B 7/04

(52) U.S. Cl. ..... 15/104.92; 15/176.2; 15/205.2; 4/654; 4/678; 401/289

(58) Field of Search ..... 15/104.92, 176.2, 15/194, 202, 205.2; 4/654, 678; 401/268, 282, 286, 289, 291

(56) References Cited

U.S. PATENT DOCUMENTS

| | | | | | |
|---|---|---|---|---|---|
| 1,041,011 | A | * | 10/1912 | Bryan | 401/289 |
| 1,333,146 | A | * | 3/1920 | Wilson | 401/286 |
| 1,344,008 | A | * | 6/1920 | Treese | 401/286 |
| 1,467,337 | A | * | 9/1923 | Runkle | 401/289 X |
| 1,928,929 | A | * | 10/1933 | Craig | 15/205.2 X |
| 2,516,778 | A | * | 7/1950 | Kreidenweiss | 15/176.2 |
| 4,311,404 | A | * | 1/1982 | Kodera | 401/289 X |
| 5,398,365 | A | * | 3/1995 | MacKenzie | 15/205.2 X |
| 6,029,292 | A | * | 2/2000 | Leiferman et al. | 15/104.92 X |
| 6,213,667 | B1 | * | 4/2001 | Isaac | 401/289 |
| 6,227,740 | B1 | * | 5/2001 | Stear et al. | 401/289 X |

FOREIGN PATENT DOCUMENTS

| | | | | |
|---|---|---|---|---|
| FI | 37327 | * | 11/1967 | 401/268 |
| SU | 645644 | * | 2/1979 | 15/104.92 |
| SU | 679202 | * | 8/1979 | 401/289 |

* cited by examiner

*Primary Examiner*—Mark Spisich
(74) *Attorney, Agent, or Firm*—Jeffrey A. Hall

(57) ABSTRACT

A cleaning device for attachment to a water faucet, comprising a housing element having a top portion and a bottom portion, the top portion being threaded for operable engagement with a water faucet, and the bottom portion having an opening therein, aperture is positioned in the housing element allowing th flow of water through the housing element. A plurality of cleaning bristles are positioned around or about the opening of the bottom portion of the housing element for cleaning fingernails, hands, razors, toothbrushes and the like.

1 Claim, 1 Drawing Sheet

MULTI-USE CLEANING DEVICE

BACKGROUND OF THE INVENTION

1. Field of Invention

This invention relates to cleaning devices, and more particularly to cleaning and scrubbing devices which are attached to faucets and other water outlets.

2. Description of the Related Art

Heretofore a wide variety of cleaning, scrubbing, scouring, and associated devices have been proposed and developed. Many devices have been proposed for cleaning and scrubbing objects, and some have been disclosed and developed for attachment to faucets.

The present invention provides a novel cleaning, scrubbing, and scouring device for attachment to faucets for cleaning fingernails, hands, razors, toothbrushes, and the like. The device of the present invention is extremely useful for use in bathrooms, kitchens, or on any water faucet, for cleaning, scrubbing, and scouring objects, hands, fingernails, and the like.

Although various type of cleaning devices are known in the prior art, none are directed to a single piece, removable cleaning device with cleaning bristles which is easily secured to or removed from a water faucet. The present invention provides a novel and unique device which is highly efficient at cleaning, scrubbing, and scouring objects, hands, fingernails and the like.

Accordingly, it is the primary object of this invention to provide cleaning device for operable attachment to a faucet, which is easily installed and/or removed if desired. The device of the present invention is also inexpensive to manufacture and use, and may be used in a wide variety of applications resulting in significant reductions in both time and labor to clean objects, fingernails, hands and the like.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims

BRIEF SUMMARY OF THE INVENTION

The present invention is a cleaning device for attachment to a water faucet, comprising a housing element having a top portion and a bottom portion, the top portion being threaded for operable engagement with a water faucet, and the bottom portion having an opening therein. An aperture is positioned in the housing element allowing the flow of water through the housing element. A plurality of cleaning bristles are positioned around or about the opening of the bottom portion of the housing element for cleaning fingernails, hands, razors, toothbrushes and the like.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE INVENTION

Reference will now be made in detail to the present preferred embodiments of the invention as illustrated in the accompanying drawings.

In accordance with the present invention, there is provided a multi-use cleaning device for attachment to a water faucet, comprising a housing element having a top portion and a bottom portion, the top portion being threaded for operable engagement with a water faucet, and the bottom portion having an opening therein. An aperture is positioned in the housing element allowing the flow of water through the housing element. A plurality of cleaning bristles are positioned around or about the opening of the bottom portion of the housing element for cleaning fingernails, hands, razors, toothbrushes and the like.

Figure 1:
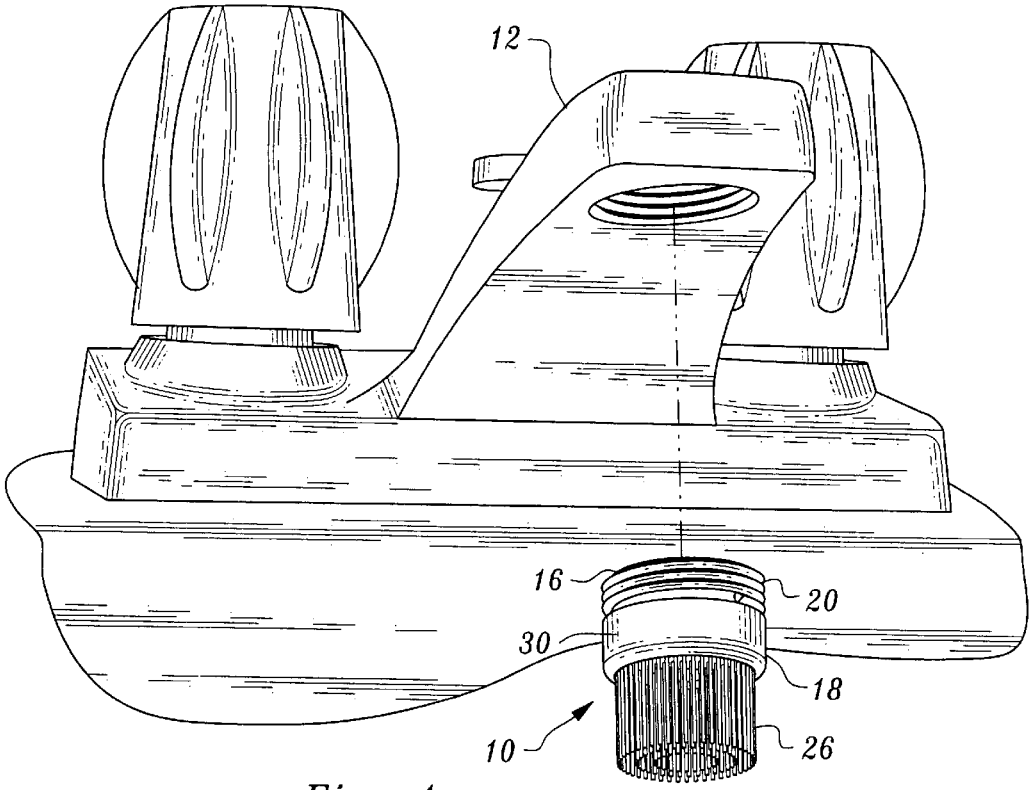
FIG. 1 is a perspective of the multi-use cleaning device of the present invention secured to a faucet, according to the invention.

In FIG. 1, multi-use cleaning device 10, is shown according to a preferred embodiment of the invention. Preferably, cleaning device 10 is secured to a water faucet 12. A housing element 14, preferably has a top portion 16, and a bottom portion 18. Top portion 16, being threaded 20, for operable engagement with a water faucet 12. Threads 20 may be either left or right handed threads, or male or female configured threads. Bottom portion 18, has an opening 22, therein.

Figure 2:
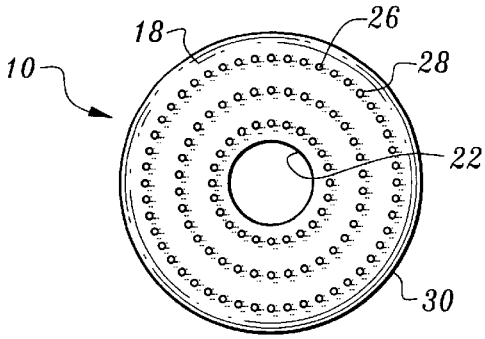
FIG. 2 shows a bottom view of such device, according to the invention.
Figure 4:
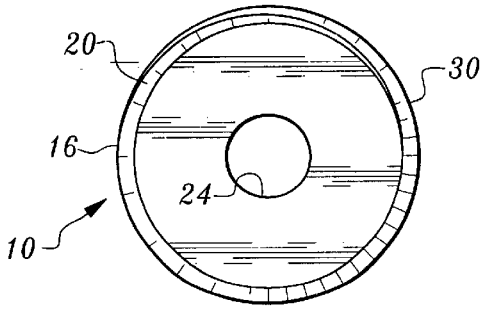
FIG. 4 shows a top view of such device, according to the invention.

Best seen in FIGS. 2 and 4, an aperture 24, in housing element 14, allows the flow of water through the housing element. Aperture 24, may be provided in different sizes, allowing different flows of water through cleaning device 10, as desired.

Figure 3:
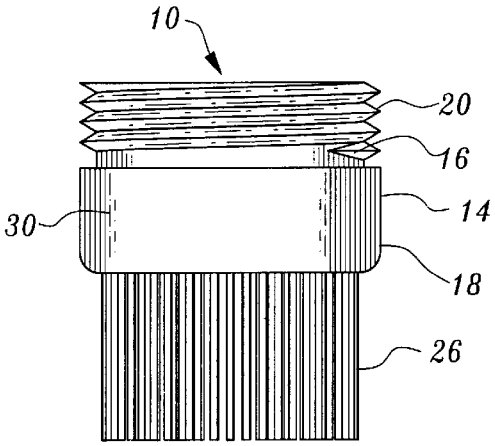
FIG. 3 shows a side view of such device, according to the invention.

As seen in FIGS. 1, 2 and 3, a plurality of cleaning bristles 26, are operably positioned around or about opening 22 of bottom portion 18, of housing element 14. Bristles 26, may be composed of nylon, plastic, or other durable resilient material. Depending upon the method of manufacture, bristles 26, may be secured either directly in housing 14, or secured in a plurality of receiving apertures 28, best seen in FIG. 2. Alternatively, an insert plate or platform with apertures may be positioned within housing element 14.

Housing element 14, preferably is provided with a curved outer surface 30, but may alternatively have planar or rectangular configurations as well. Of course, it is critical, regardless of the configuration of housing 14, to have threads 20 be operably exposed so engagement with the faucet 12 is possible. Housing element 14, is preferably composed of a durable, resilient material, such as plastic or metal.

In operation and use multi-use cleaning device 10, is highly efficient for cleaning razors, fingernails, combs, hands, and other objects by simply securing housing element 14 to a water faucet and then either first turning on the water and then scrubbing the object with bristles 26, or alternatively, first scrubbing the object and then turning on the water.

As is evident from the above description, a wide variety of cleaning devices may be configured for may different applications which utilize the multi-use cleaning device described herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A cleaning device for attachment to a water faucet, comprising:

a housing element having a top portion and a bottom portion, the top and bottom onion each being generally circular in cross-section, the portion being externally threaded for direct engagement with a water faucet, the top portion including the threads thereon and the bottom portion having substantially the same diameter;

a central aperture passing through both the top and bottom portions of the housing element which terminates at a central opening in the bottom portion, said aperture allowing the flow of water through said housing element, the remainder of the bottom portion of the housing element being free of any additional water-supplying apertures; and a plurality of bristles received in bristle-receiving said bottom portion, the cleaning bristles being arranged in generally concentric circular rings around the opening in the bottom portion of the housing element.

* * * * *